United States Patent [19]

Katsuta et al.

[11] Patent Number: 4,483,487

[45] Date of Patent: Nov. 20, 1984

[54] VERTICAL ROLLER MILL

[75] Inventors: Susumu Katsuta; Susumu Adachi; Hoshino Shuji, all of Tokyo, Japan

[73] Assignees: Ishikawajima-Harima Jukogyo Kabushiki Kaisha; Sumitomo Cement Kabushiki Kaisha, both of Tokyo, Japan

[21] Appl. No.: 367,243

[22] PCT Filed: Aug. 20, 1981

[86] PCT No.: PCT/JP81/00181

§ 371 Date: Mar. 30, 1982

§ 102(e) Date: Mar. 30, 1982

[87] PCT Pub. No.: WO82/00601

PCT Pub. Date: Mar. 4, 1982

[30] Foreign Application Priority Data

Aug. 21, 1980 [JP] Japan ..... 55-114927

[51] Int. Cl.[3] ..... B02C 15/00

[52] U.S. Cl. ..... 241/121; 241/285 B

[58] Field of Search ..... 241/117, 119, 120, 121, 241/122, 285 R, 285 B

[56] References Cited

U.S. PATENT DOCUMENTS

| | | | |
|---|---|---|---|
| 3,822,829 | 7/1974 | Brundiek et al. | 241/285 R X |
| 4,000,860 | 1/1977 | Gotham | 241/285 B X |
| 4,339,086 | 7/1982 | Brundiek | 241/121 |

FOREIGN PATENT DOCUMENTS

| | | |
|---|---|---|
| 2735 | 1/1961 | Japan . |
| 125869 | 10/1977 | Japan . |

*Primary Examiner*—Mark Rosenbaum

[57] ABSTRACT

Disclosed is a vertical roller mill wherein a material fed to a casing is ground between a rotary table and a plurality of grinding rollers which are pressed against the rotary table and are rotated as the rotary table is rotated, the ground material being entrained by the upblast of heated gas or the like and discharged out of the casing. A bracket extended above the rotary table for carrying the grinding roller is pivoted at the side of the casing, and a pull-down means is connected with the bracket adjacent to the part thereof at which the grinding roller is supported. The bracket is pulled down by the pull-down means so that the grinding roller may be pressed against the rotary table.

1 Claim, 3 Drawing Figures

VERTICAL ROLLER MILL

TECHNICAL FIELD

The present invention relates to a vertical roller mill which can force grinding rollers against a rotary table in a very effective manner, which can be made considerably light in weight and which can facilitate inspection and maintenance.

Vertical roller mills have been widely used to grind materials such as coal or cement raw materials into desired size of finely divided particles. In general, the material fed into the casing is pulverized between the rotary table and the grinding rollers which are pressed against the rotary table to rotate in accordance with the rotary table, and the pulverized particles are carried outside of the casing by the preheated gas or the like blown upwardly around the rotary table.

The conventional vertical roller mills are divided into the "swing arm" type mill (e.g., Japanese Pat. No. 454825) and the "press ring" type mill (e.g., Japanese Patent Public Disclosure No. 125869/1977). These mills have some problems in forcing their grinding rollers against the rotary table as will be described below.

In the case of the "swing arm" type mill, a swing arm extends from a stand installed exterior of a mill casing into the interior of the casing. A grinding roller is supported at the leading end of the swing arm and pressed against a rotary table by inclining the swing arm by inclining means.

As the result, there arise the following problems.

(1) Since the stand and associated parts are installed exterior of the casing, a wide installation space is needed.

(2) Since the grinding force is applied to the grinding roller through the swing arm which is long, the swing arm must have extremely high strength against bending. As a result, the swing arms, the stand and the inclining means all become large in size and heavy in weight.

(3) Since the point of the swing arm at which acts the inclining means (that is, the point of application) is considerably spaced apart from the grinding surface of the roller (that is, the point of action), an extremely strong force is needed to press the grinding roller against the rotary table.

(4) The swing arm is inclinably extended from the exterior of the mill casing into the interior thereof so that a gap or clearance exists between the casing and the swing arm. As a result, the air leaks in large quantities into the casing so that a blower with a high capacity is required so as to discharge the pulverized particles.

In the case of the "press ring" type mill, a press ring (circular or triangular in shape) is disposed on three rollers and three hydraulic cylinders which connect the press ring to the base plate force the rollers against the rotary table.

Such mill has the following problems.

(a) Since one top ring must press three grinding rollers, it becomes large in size and heavy in weight.

(b) The irregular motion of one grinding roller adversely affects the grinding motions of the remaining grinding rollers.

(c) Since the top press ring is large in size and heavy in weight, the replacement of roller liners becomes time-consuming and cumbersome. As a result, in general, all the grinding roller liners must be replaced at the same time. As a consequence, the "press ring" type mill is not advantageous from the standpoint of economy and maintainability.

In view of the above, the object of the present invention is to provide a vertical roller mill which can force grinding rollers against a rotary table in a very effective manner, which can be made very light in weight and which can facilitate inspection and maintenance.

DISCLOSURE OF THE INVENTION

According to the present invention, brackets have their one ends connected to grinding rollers and the other ends pivoted at the side of a casing and are pulled downward at a portion adjacent to the roller mounting position, the grinding rollers being pressed against a roller table, whereby the material is pulverized into desired particles or powder between the grinding rollers and the roller table. In this way, by pulling directly downward the brackets at their portion adjacent to the roller mounting position, reinforcement members for the brackets may be short in length and small in size, whereby the overall weight of the mill apparatus may be greately reduced; maintenance and inspection such as replacement of roller liners may be facilitated; roll liners may be individually replaced, which facts are advantageous from an economical viewpoint. Moreover, during pulverization, grinding pressures of the respective rollers may be individually adjusted in accordance with the accumulated volume of the pulverized material, etc. and the change in pressure of one roller will not adversely affect the grinding actions of the remaining grinding rollers.

BEST MODE FOR CARRYING OUT THE INVENTION

The present invention will become more apparent from the following description taken in conjunction with the accompanying drawings.

Figure 1:
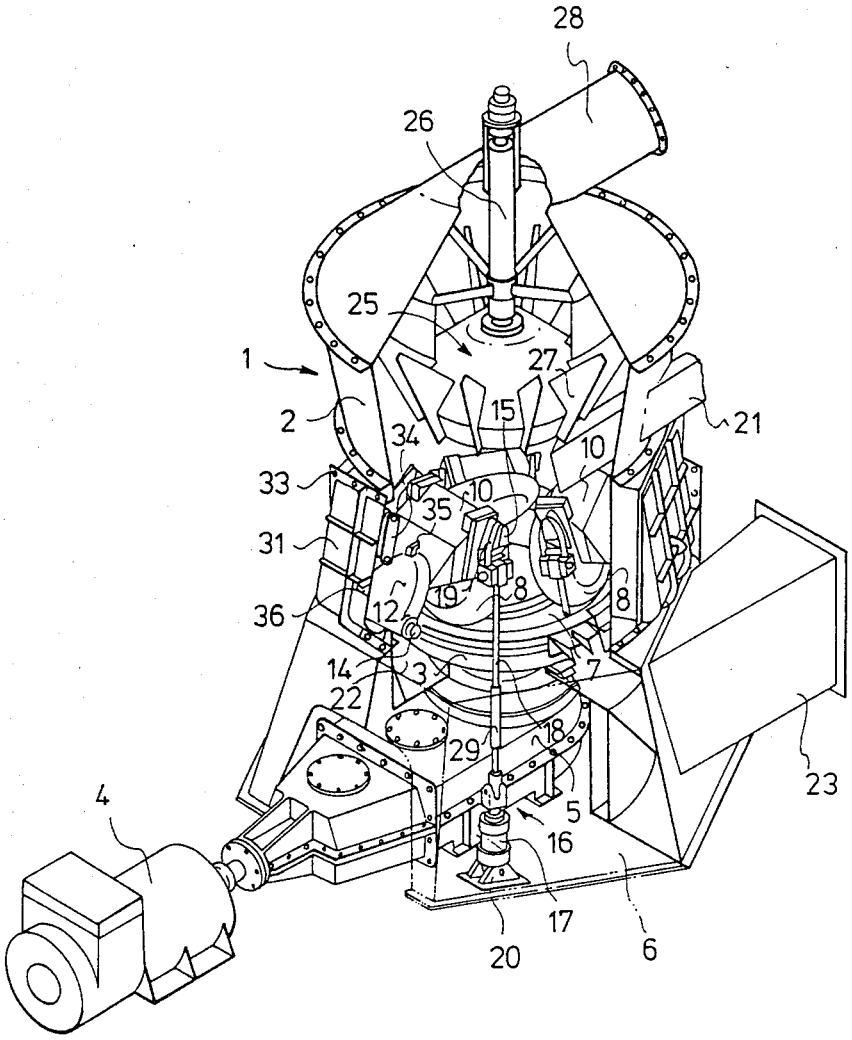
FIG. 1 is a perspective view, partly cut out, of an embodiment of a vertical roller mill in accordance with the present invention.
Figure 2:
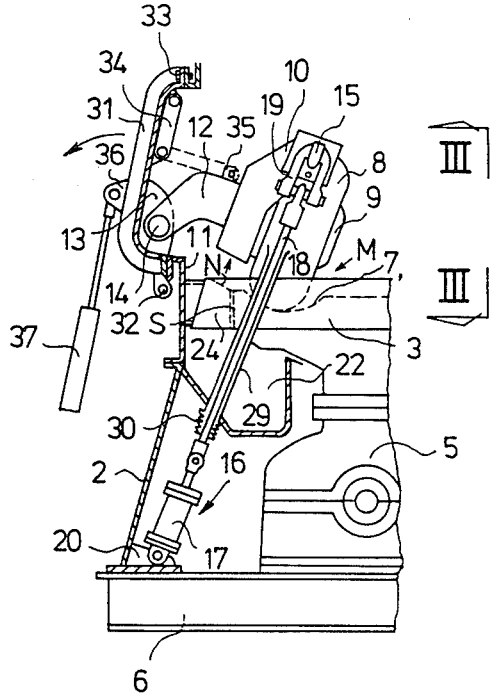
FIG. 2 is a fragmentary schematic sectional view thereof.

Referring to FIG. 1, a vertical roller mill generally indicated by the reference numeral 1 has a casing 2. A rotary table 3 is disposed at the lower portion of the casing 2 and is drivingly coupled to a prime mover 4 installed exterior of the casing 2 through a reduction gear 5. The reduction gear 5 is mounted on a base 6 of the casing 2 so as to support the rotary table 3. As best shown in FIGS. 1 and 2, an annular groove 7 is formed in the upper surface of the rotary table 3 and grinding rollers 8 are disposed in the annular groove 7 at suitable intervals to form a grinding area M. In the illustration, three grinding rollers 8 are equiangularly disposed.

Figure 3:
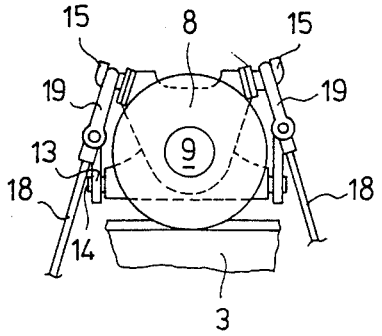
FIG. 3 is a sectional view taken along the line III—III of FIG. 2.

Each roller 8 has a shaft 9 supported by a bracket 10 and an arm 12 is extended from one end of the bracket 10 toward the inner wall 11 of the casing 2. The casing 2 is provided with rectangular doors 31 respectively adjacent to the grinding rollers 8 so that the latter can be taken out of the casing 2. The door 31 is pivoted with a pin 32 so that the door 31 is swingable about the pin 32. The peripheries of the door 31 are securely attached to the casing 2 with bolts 33. The leading end of the arm 12 is pivoted with a pin 14 to a supporting bracket 13 which in turn is attached to the inner wall of the door 31. As best shown in FIG. 3, the bracket 10 has two projections extending outwardly and radially in two directions and the leading ends of these projections terminate in hooks 15 which are directed upwardly.

A force application mechanism 16 for pulling the bracket 10 downward so as to force the grinding roller 8 against the annular groove 7 of the rotary table 3 comprises, in general, a hydraulic cylinder 17, a tension link 18 and a shackle 19. The bottom of the hydraulic cylinder 17 is pivoted to a bracket 20 which in turn is securely joined to the inner wall surface of the casing 2 adjacent to the base 6 and/or to the base 6 itself. The ring of the shackle 19 is engaged with the hook 15 and one end of the tension link 18 is connected to the shackle 19 while the other end is connected to the hydraulic cylinder 17.

In order that the material to be pulverized may be admitted to the center of the rotary table 3, a chute 21 is arranged above the rotary table 3 and is extends through the casing 2 at a proper angle relative to the horizontal, one end of the chute being open toward the rotary table 3.

An annular heated-gas supply duct 22 is arranged below the peripheral portion of the undersurface of the rotary table 3 in such a way that the clearance between the rotary table 3 and the inner wall 11 of the casing 2 is closed and that the interior of the casing 2 is divided into the grinding area M and a lower chamber below the rotary table 3 and the grinding area M is normally maintained air-tight.

A duct 23 is provided outside of the casing 2 for introducing a heated gas into the annular duct 22, and a blower (not shown) is provided for blowing the heated gas into the duct 23. As best shown in FIG. 2, the peripheral side wall S of the rotary table 3 is surrounded with an annular nozzle ring 24 so that a nozzle N is defined through which the heated gas is blasted upward from the annular duct 22 into the grinding area M. The inner peripheral side wall of the annular nozzle ring 24 is spaced apart from the peripheral side wall S of the rotary table 3 by a suitable distance.

A classifier 25 is disposed in the casing above the rotary table. The partly pulverized material is picked up at the periphery of the rotary table by the heated gas blasted upward through the nozzle N and carried to the centrifugal classifier 25. The pulverized particles pass through the classifier 25 with the heated gas while the oversize particles are returned to the grinding elements. As best shown in FIG. 1, the classifier 25 comprises a driving shaft 26 extending through the top of the mill casing 2 and a plurality of classifying blades or vanes 27 supported by the driving shaft 26. The pulverized particles are discharged together with the heated gas through a discharge duct 28 extending outwardly from the top of the casing 2.

The tension link 18 extends through the annular duct 22 and the annular nozzle ring 24. As best shown in FIG. 2, the tension link 18 is sheathed in a protective tube 29 so that the direct exposure of the tension link 18 to the heated gas flowing through the annular duct 22 and the nozzle N may be prevented. The lower portion of the protective tube 29 is sealed by a bellows seal 30 adjacent to the wall of the annular duct 22 so as to prevent the leakage of hot gas from the annular duct 22.

Next the mode of operation of the vertical roller mill with the above-described construction will be described.

The material such as coal or cement raw material is dropped at the center of the rotary table 3 from the chute 21 and is forced toward the grinding area M. The piston rods of the hydraulic cylinders 17 are retracted so that the tension links 18, the shackles 19 and the bracket 10 connected with the shackles 19 through the hooks 15 are pulled down and consequently the grinding roller 8 is pressed against the rotary table 3 or the grinding surface of the annular groove 7 thereof and caused to rotate as the rotary table 3 rotates. The material is pulverized between the rotary table 3 and the grinding rollers 8.

According to the present invention, the bracket 10 which supports the grinding roller 8 is connected through the hooks 15 and the shackles 19 to the tension links 18 which in turn are connected to the hydraulic cylinder 17. As a result, the forces developed by the hydraulic cylinders 17 are effectively transmitted to the bracket 10 so that the grinding roller 8 is forcibly pressed against the rotary table 3. In addition, the force application mechanisms 16 each of which comprises the hydraulic cylinder 17, the tension link 18 and the shackle 19 are simple in construction and light in weight so that the overall weight of the vertical roller mill 1 can be considerably reduced. Furthermore, the grinding pressures applied to the grinding rollers 8 can be individually adjusted depending upon the grinding conditions and the change in grinding pressure of one grinding roller will not adversely affect the grinding actions of the remaining grinding rollers 8.

The hot gas is admitted into the annular duct 22 through the heated-gas inlet duct 23 and blown upward through the nozzle N between the rotary table 3 and the annular nozzle ring 24.

The pulverized particles are forced toward the periphery of the rotary table 3 owing to the centrifugal force and picked up and carried by the upblast of the heated gas toward the classifier 25 while being dried. Finely divided particles pass through the classifier 25 with the hot gas and are discharged through the discharge duct 28, but oversize particles are separated by the rotating classifying blades or vanes 27 and forced downward along the inner wall 11 of the casing 2 owing to the centrifugal force. Thereafter the oversize particles are returned to the rotary table 3.

According to the present invention, the force application mechanisms 16 are disposed within the casing 2 so that grinding area M of the casing 2 can be easily maintained air-tight and the leakage of the air into the casing 2 can be reduced to a minimum. As a result, the flow rate of the heated gas can be reduced and consequently the power of the blower can be lowered.

Next the steps for replacement of the roll liners of the grinding rollers 8 will be described.

First a cover (not shown) provided adjacent to the door 31 of the casing 2 is opened and an operator inserts his hand into the casing 2 so as to swing a lever 34, which is pivoted with a pin to the inner wall surface of the door 31, to the position indicated by the broken lines in FIG. 2 and engage it with a hook 35 extending from the arm 12. Thereafter the piston rods of the hydraulic cylinders 17 are extended upward so as to disengage the shackles 19 from the hooks 15. Next the bolts 33 of the door 31 are unfastened and the piston rod of a hydraulic cylinder 37 is connected with a pin to an eye plate 36 extending outwardly of the door 31. The piston rod of the hydraulic cylinder 37 is withdrawn so that the door 31 together with the grinding roller 8 and its bracket 10 are rotated about the pin 32 and consequently the grinding roller 8 is carried outside of the casing 2. Thereafter the liner of the grinding roller 8 can be easily replaced with a new one.

Instead of the cantilever-like bracket 10 as illustrated by which the shaft 9 of the roller 8 is supported only at its one side adjacent to the inner wall 11 of the casing, a bracket of the type by which the shaft 9 is supported at its opposed sides may be used.

Instead of the tension links 18, wires may be used. In this case, one end each of the wires is connected to the shackles 19, respectively, which in turn are engaged with the hooks 15 of the bracket 10. The other ends of the wires are spliced and connected to the piston rod of a hydraulic cylinder anchored to the base 6. This arrangement is advantageous in that the number of hydraulic cylinders can be reduced.

CAPABILITY OF EXPLOITATION IN INDUSTRY

As is clear from the foregoing, a vertical roller mill according to the present invention is useful as an apparatus for grinding materials such as coal or cement raw material into desired size of particles or powder.

We claim:

1. A vertical roller mill having a casing, a rotary table rotatably disposed within said casing, a plurality of grinding rollers having axes of rotation above said rotary table and arranged in suitable intervals with each other in the direction of rotation of said rotary table and contacting said rotary table at contact points, a plurality of brackets respectively supporting said grinding rollers, a plurality of openable doors pivotally connected to said casing respectively adjacent said grinding rollers, a plurality of connecting members each having one end pivotally connected to the respective door and the other end being connectable to the respective adjacent bracket, each bracket having one end connected to the respective adjacent door, the other end of each bracket having two spaced projections located in a plane which is perpendicular to the respective grinding roller axis and substantially including said contact point between the respective roller and the rotary table, said projections being arranged symmetrically with respect to a vertical plane including the respective roller axis, and force-application means engaged with said projections to forceably pull down the respective grinding roller and press the same against the said rotary table; said bracket and thereby said respective roller being swingable from said plane through said contact point to a location outside said casing, by opening the respective door, upon engagement of said other end of said connecting member with said bracket and upon disengagement of said projections from said force-application means.

* * * * *